US006148522A

United States Patent [19]

Dobandi

[11] Patent Number: 6,148,522

[45] **Date of Patent: *Nov. 21, 2000**

[54] DUAL-BLADE UTILITY KNIFE

[76] Inventor: Frank Dobandi, 2941 NE. 8th Ter., Pompano Beach, Fla. 33317

[ * ] Notice: This patent issued on a continued prosecution application filed under 37 CFR 1.53(d), and is subject to the twenty year patent term provisions of 35 U.S.C. 154(a)(2).

[21] Appl. No.: 08/951,837

[22] Filed: Oct. 16, 1997

Related U.S. Application Data

[60] Provisional application No. 60/028,957, Oct. 18, 1996.

[51] Int. Cl.[7] ..... B26B 1/00

[52] U.S. Cl. ..... 30/162; 30/335

[58] Field of Search ..... 30/162, 287, 299, 30/304, 305, 317, 334, 335

[56] References Cited

U.S. PATENT DOCUMENTS

| | | | |
|---|---|---|---|
| D. 355,345 | 2/1995 | Drust | D8/99 |
| D. 386,381 | 11/1997 | Black et al. | D8/99 |
| 4,578,865 | 4/1986 | Keller | 30/335 X |
| 4,890,387 | 1/1990 | Canino | 30/162 X |
| 5,093,994 | 3/1992 | Karas | 30/162 X |
| 5,230,152 | 7/1993 | Kennedy | 30/335 X |
| 5,337,481 | 8/1994 | Mears | 30/335 X |

FOREIGN PATENT DOCUMENTS

| | | | |
|---|---|---|---|
| 0230000 | 7/1987 | European Pat. Off. | 30/162 |
| 004304742 | 8/1994 | Germany | 30/162 |

*Primary Examiner*—M. Rachuba

[57] ABSTRACT

A dual blade utility knife that includes double-ended, retractable, separately actuatable cutting blades, one at each end, permitting extension of only one blade at a time, mounted in a non-complex housing unit that allows ready access through individual access panels to exchange and replace a single end blade when necessary. The utility tool is also capable of using the same type of blade at each end or different types of blades and dual-faced blades so that each blade can be reversed for extending the life and use of the tool between blade changes.

2 Claims, 5 Drawing Sheets

DUAL-BLADE UTILITY KNIFE

This application is based on Provisional Application Ser. No. 60/028,957 filed Oct. 18, 1996.

BACKGROUND OF THE INVENTION

1. Field of the Invention

This invention relates generally to a dual-blade utility knife having a common housing and dual cutting blades, one extendible from each end of the housing, one operable at a time, and specifically, to an improved dual-blade utility knife that is of improved economy to manufacture and increased utility to the user by allowing easier blade access and exchange.

2. Description of the Prior Art

The use of single-blade utility knives is well known. Typically, a conventional utility knife includes one replaceable blade, each blade looking much like a single-edge razor blade used for all types of cutting jobs in the construction industry. For example, cutting roof shingles requires a utility blade or utility knife.

One of the most time consuming aspects of using a utility knife is that the user requires different types of blades to perform single operations. Rather than use a plurality of independent hand-held utility knives, a dual-blade construction is desirable. Typically, in a dual-blade utility knife, each end of the blade handle and housing may contain a different blade for a different or function. Also, to extend the life of the blade or utility tool, the same type of blade can be held at each end and when one becomes dull, the user can select the opposite end blade.

The prior art shows different types of dual-blade utility knives. U.S. Pat. No. 5,230,152, issued Jul. 27, 1993 to Kennedy, shows a dual-blade utility knife employing a single actuator connected to two blades. U.S. Pat. No. 5,337,481, issued Aug. 16, 1994 to Mears, shows a dual-blade utility knife having two blades in parallel, each one extendable from the same end of the device, with the opposite end being a handle. U.S. Pat. No. 5,093,994, issued Mar. 10, 1992 to Karas, shows a double-ended, retractable knife which includes an extra storage chamber.

Each of the utility knives and tools shown in the prior art requires multiple sub-components, individually molded, and somewhat complex in their operation, which drives up the cost of the unit. Also, they are not readily accessible as to each blade for interchanging of blades, while at the same time insuring that only one blade can be retracted at a time for safety purposes.

The present invention overcomes the problems shown in the prior art by providing a double-ended, retractable utility tool or knife that has separately actuatable blades, one at each end, that permits extension of only one blade at a time, mounted in a non-complex housing that can be easily molded to greatly reduce the cost of the unit. The blades are also readily accessible through access panels, one on each side, for exchange and replacement when necessary. The utility tool is also capable of using the same type of blade at each end (including a single blade having two blade ends that can be reversed to extend the time between blade changes), or with different types of blades at each end, depending on the needs of the user.

SUMMARY OF THE INVENTION

A dual-blade utility knife which has a single blade disposed in its own compartment, one at each end of the device, each blade of which is independently extendable and retractable into the elongated housing which also acts as a dual handle, each of said blades being extendable only one at a time, restricting movement of the non-extended blade, for safety reasons.

Each blade can be razor-sharp and substantially like a razor blade with a single edge, and include a blade body portion that allows it to be connected to a blade mount attached to a slidable knob which is the actuating knob operably connected into the housing.

The housing for the device is essentially made of three separate components. The first and most essential component is an elongated blade receptacle housing having two mirror-image compartments, one at each end of the device, and which is mirror-imaged along the transverse center line, forming a Z-shaped, single housing component which receives each blade, one at each end. Two identical detachable molded blade covers, one mountable and attachable via screw or other fastener at each end completes the housing and the covering of the blades.

At each end of the housing is an opening slot formed between the main longitudinal housing component and the component blade cover at that end, which allows the blade to be moved and extended outwardly from the slot at each end.

The housing includes longitudinal top openings or passageways that have recesses that accept a blade restraining loop that acts in conjunction with the actuating knob and knob holder that connects to each blade. The restraining loop can stop the movement of one of the blades by engaging the blade actuator button whenever the opposing blade has been fully extended out of the slot in the operable condition.

This provides for three modes of operation with the device. The first mode of operation is when none of the blades are in use and both actuating buttons have been depressed inwardly and moved linearly (toward the center of the housing) so that both blades reside inside the housing in the "safe" position. This is the non-operation of the tool.

The second operational position is having one blade extended from one end while the other blade is held restricted from being moved by the restraining loop. The user can easily, efficiently, and safely use the extended blade without worrying about the other blade being accidentally extended.

In the third mode of operation, the first blade discussed above is retracted and the second blade is extended.

To construct the housing, a first mold can be used to form the main housing, which is substantially Z-shaped, and includes half of the passageway and recess ledge that allows the operating or actuating button to slide, and also receives the restraining loop. The blade covers fit snugly and symmetrically on each side of the longitudinal axis of the housing, and each blade cover or housing cover is identical, requiring only a single second mold. Provision for blade storage in this component can also be made.

The main housing component includes a threaded, circular passage that engages a threaded fastener, such as a screw, that is used to removably fasten one of the blade covers, one at each end.

Each blade, which can be either of an identical style or multiple blades of different styles, can be employed in the device in either compartment. Each blade can include two separate operating heads which are reversed to extend the time between blade disposal and replacement.

In order to change the blade once it is dull or to change the style of the blade for different utilitarian purposes, the user merely loosens or unfastens the screw holding the blade cover in place against the housing, allowing direct access to one particular blade. The blade is removed from the blade-actuating button and holder and replaced with the desired blade. Once the cover has been reinstalled, the device is ready for use.

The restraining loop is an elliptically-shaped band that fits down in a recessed portion that forms the actuating slot along the top of the housing to permit a sliding passageway for the actuating button for each blade and the post connected to the actuating button that attaches to each blade. The actuating loop is of a predetermined elliptical distance from its end points. That distance is less than the distance required to allow both blades to be extended simultaneously from the housing. When one blade is fully extended by moving the actuating button all the way along the slot towards one end of the housing, the restraining loop moves a distance sufficient to hold the opposing blade, actuating button, and post in a fixed, retracted position, preventing outward movement, even by the user of the device, if the first blade is extended.

Each of the blades may include detent or spring locking in the extended position, such that when both blades are in a retracted position, the blades can be detent locked in place.

The blades employed in the device may themselves each be reversible to double the amount of time or life of the blade in use by rotating it in each blade connector.

It is an object of this invention to provide a dual-blade utility knife of reduced cost and increased efficient operability.

It is another object of this invention to provide an improved dual-blade utility knife which has a unique, low-cost housing that allows easy access to each blade individually for replacement.

In accordance with these and other objects which will become apparent hereinafter, the instant invention will now be described with particular reference to the accompanying drawings.

DESCRIPTION OF THE PREFERRED EMBODIMENTS

Figure 1:
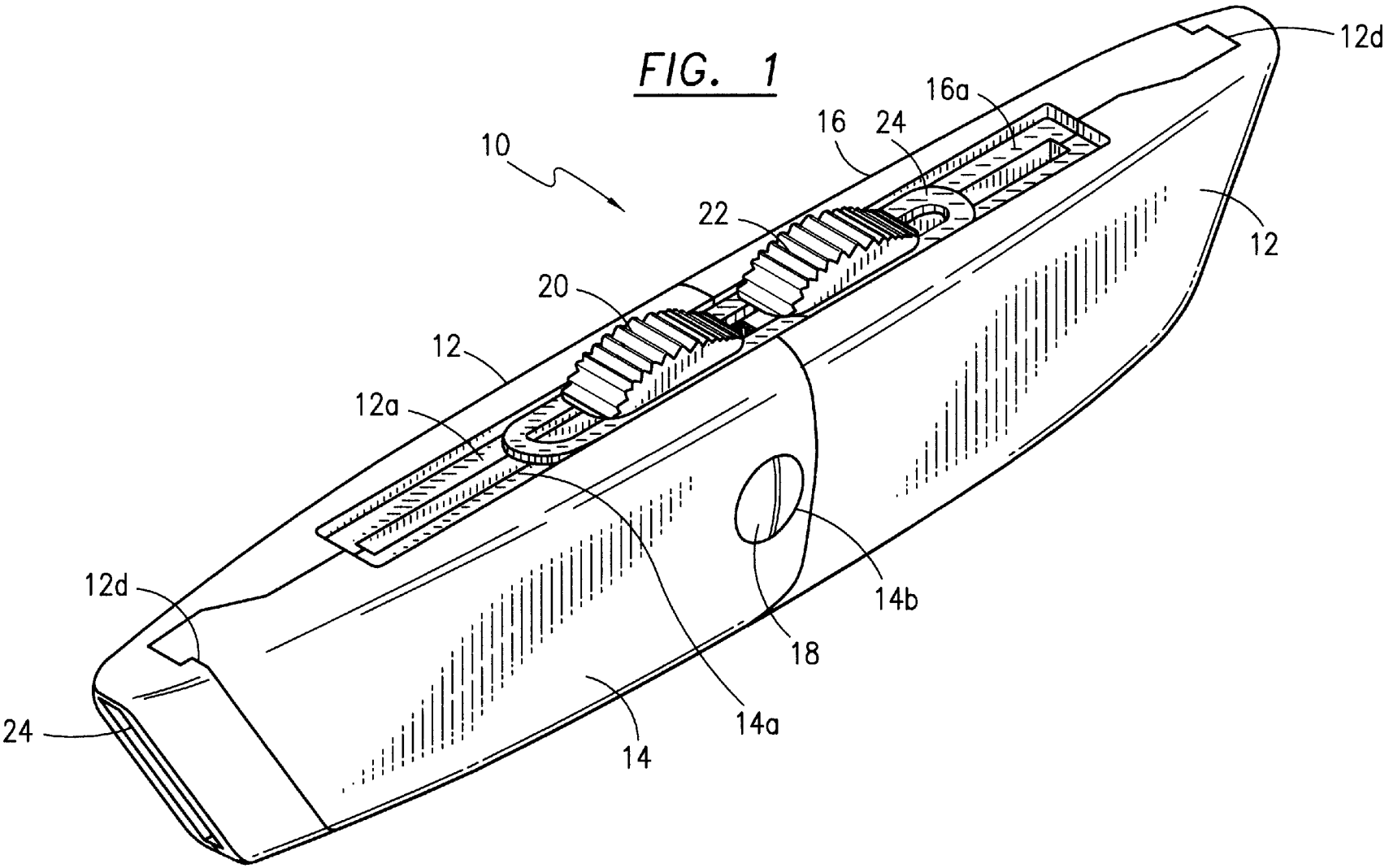
FIG. 1 shows a perspective view of the present invention

Referring now to the drawings and in particular to FIG. 1, the present invention is shown generally at 10, comprised of a Z-shaped blade housing 12 having a pair of blade covers 14 and 16 that are identical in structure, with the blade cover 14 being attached to housing 12 by a screw 18 mounted through aperture 14*b* in blade holder 14.

Along the top center line of the housing 12 are a pair of blade actuating knobs 20 and 22 which are mounted in recessed channels 12*a*, 14*a*, and 16*a*, defined along the top of the housing and blade covers. Each of the knobs is capable of being moved linearly along the channel defined in the recesses 12*a* and 14*a* and 16*a*. A blade restraint device or retainer 24 is a rigid loop connected beneath actuating knobs 20 and 22, which prevents both blades from being extended from each end of the housing 12 at the same time. This is explained in greater detail below. The device as shown in FIG. 1 is the non-operational position where both blades are retracted inside of housing 12.

The embodiment in FIG. 1 shows an interlock 12*d* which allows portions of the housing 12 to interlock with corresponding portions of blade covers 14 and 16, so that near the ends of the housing 12, the blade covers do not move laterally because of the interlock, which is an overlapping, stair-step. The projecting portion on the housing 12*d* prevents lateral movement at either end of blade covers 14 and 16 as shown. The embodiment in FIG. 2 does not show the interlock for simplicity sake.

Figure 2:
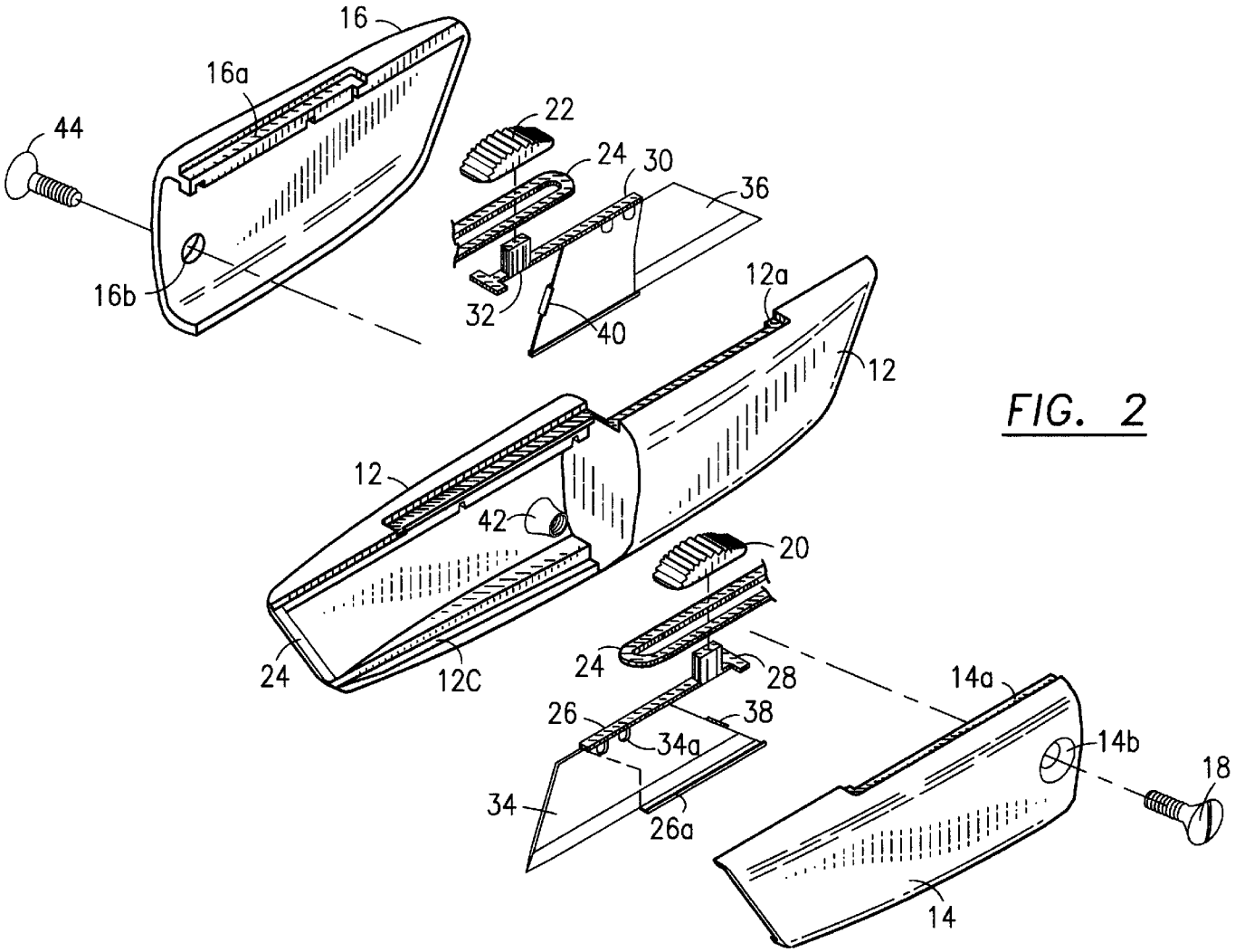
FIG. 2 shows a perspective exploded view of the present invention.

Referring now to FIG. 2, it should be noted that blade cover 16 is removably connected to housing 12 by a bolt 44 or screw 44 that goes through the blade cover 16 through aperture 16*b*. Blade cover 16 also includes a recessed portion that abuts the housing recess portion 12*a*. Removal of blade cover 16 allows access to blade 36, connected to a blade holder 30, attached to knob holder 32, that connects to the actuating knob 22. Note that the retaining loop 24 is shown broken apart in FIG. 2, but is one continuous piece.

Blade cover 14 is removably attached to housing 12 with a screw 18 that threadably fits into female threaded fastener 42, which is rigidly formed as part of housing 12. Removal of blade cover 14 allows access to blade 34 where it can be changed or rotated from end to end. Blade 34 is secured by blade holder 26 that is connected to knob 20 by knob post 28.

Blade holder 26 includes a blade stop 38 and a recessed support 26*a* upon which the blade rests.

The housing 12 is symmetrically shaped with respect to each end and includes an opening at each end 241 and 241*a* that allows the blade to protrude from inside the housing to outside the housing in the operating position. The retaining or restraining loop 24 prevents both blades from being actuated outside the housing 12 at the same time. As seen in FIG. 2, the overall housing includes the Z-shaped housing 12, which can be formed as a unitary piece, and a pair of blade covers 14 and 16, each of which is identical and formed from a single mold.

Figure 3:
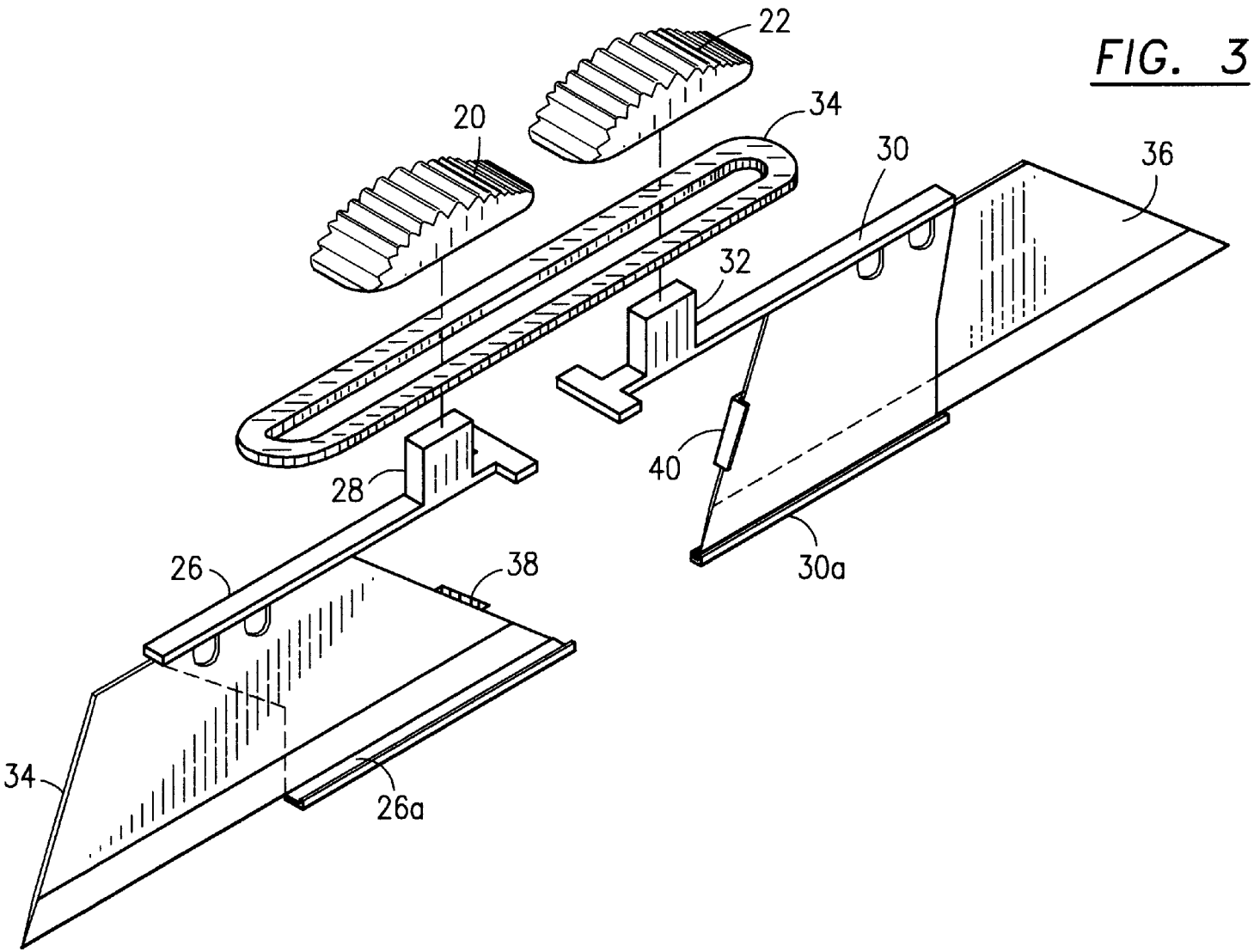
FIG. 3 shows a perspective exploded view of the blades and the actuating knobs and blade holders of the present invention.

FIG. 3 shows the blades and blade activating device wherein actuating knob 20 moves blade 34 and blade holder 26 by linear movement toward and away from the end of housing 12. Likewise, knob 22 reciprocally and linearly is movable and connected to blade holder 30 and post 32 to allow the retraction or extension of blade 36 out the opposite end from blade 34. However, because of the predefined interior diameter of restraining loop 24, extension of one blade out of the end in an operating position prohibits movement of the other blade outside the housing because of the restraint loop. As shown in FIG. 3, each of the blades 34 and 36 are independently removable from blade holder 26 and 30, respectively, and can be reversed for extended time between blade changes by merely reversing the position of the blade in the blade holder.

Figure 4B:
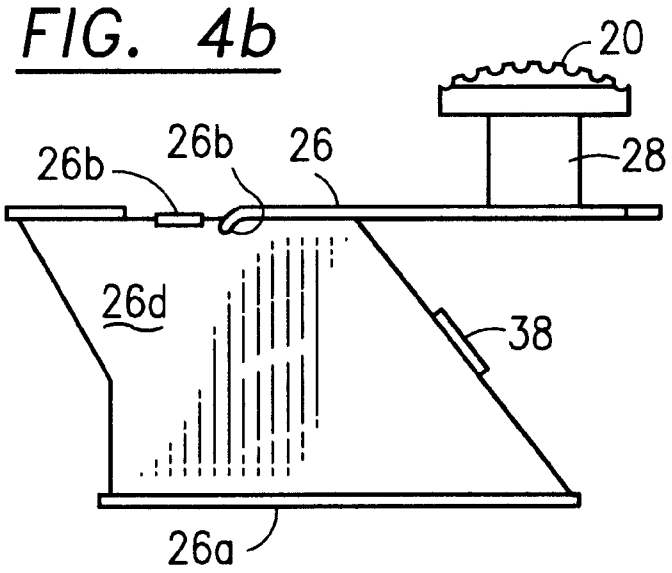
FIG. 4*b* shows a side elevational view of the blade actuating button, the blade holder, and the actuating post for connecting the blade to the blade holder.
Figure 4A:
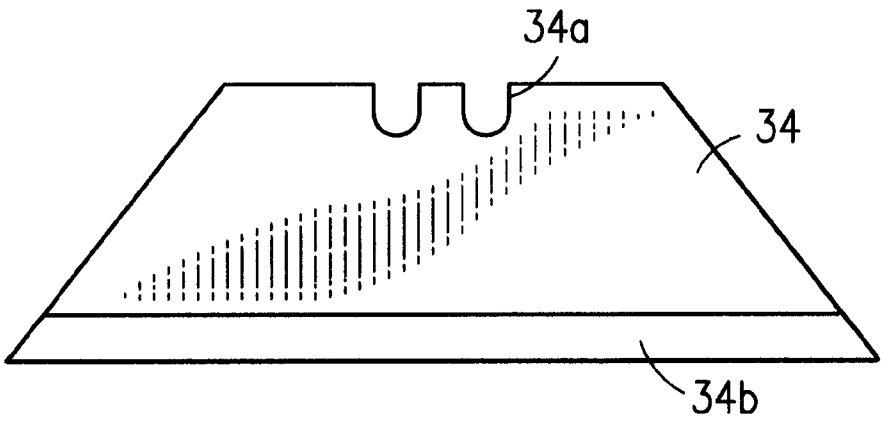
FIG. 4*a* shows a single blade that can be used at one end of the present invention in a side elevational view. Notice that the blade is double-ended and can be reversed in operation for extending blade life at each end.

FIG. 4*a* shows a conventional or typical blade used in the present invention that includes a recessed portion 34*a* along the top edge of the blade and a sharp edge portion 34*b*. When the blade 34 is inserted into blade holder 26 (shown in FIG. 4*b*), the blade is stopped by a blade stop 38, and the blade holder includes a vertical wall 26*d*, a recessed support 26*a* connected to wall 26*d*, and a blade holder 26*b* that fits inside recessed portion 34*a* on the blade to hold it firmly in position. The end tip 26*c* of the blade holder portion also acts to provide force on the blade to hold it in position until it is manually removed. The blade holder 26*b* tension device that fits in recess 34*a* of the blade can be manually, resiliently moved to allow the blade to be removed. Thus, 26*b* element is resilient to hold the blade in place, but can be moved to allow the blade to be removed. The blade operation for blade 36 is identical.

Figure 5:
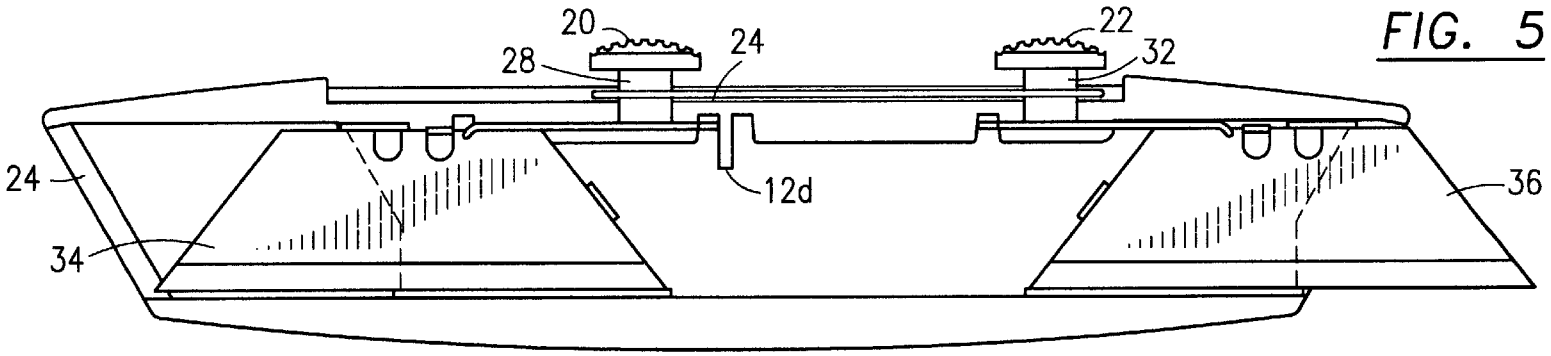
FIGS. 5, 6, and 7 shows side elevational views, partially in phantom, schematically to show the operation and independent actuation of each of the dual blades as used in the present invention.

Referring now to the overall operation of the device, FIG. 5 shows blade 36 extended by moving knob 22 toward the end opening in the housing 12, while blade 34 is retained in the housing because the restraining loop 24 will not permit linear movement of blade 34 through actuation of knob 20 in a linear direction toward the open end of the housing.

Figure 6:
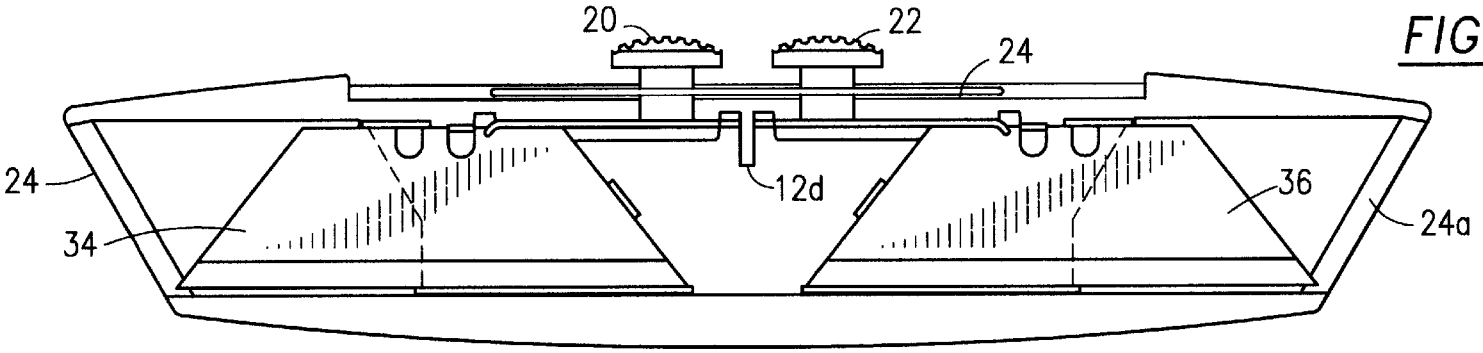

FIG. 6 shows the non-operational position with both blades retracted and retained in the housing with both blade holders being pushed against the interior wall or barrier 12*d* of the housing.

Figure 7:
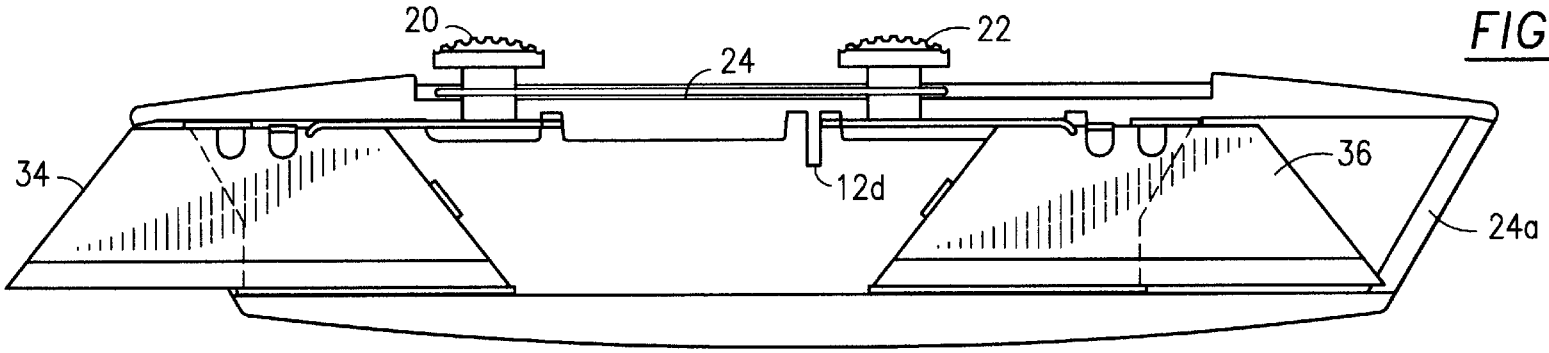

Finally, in FIG. 7, blade 34 is shown extended through the actuation of knob 20, pushing it toward the outside end of the housing, away from barrier 12*d*, thus having the restraining loop 24 prevent outward movement of blade 36 which locks it firmly in the housing.

Thus, it can be seen that the blade permits only single-blade extension for safety purposes. Each blade can be reversed for extending the life or time between blade changes, which greatly increases the use of the knife on the job. Thus, in effect, the embodiments shown herein include four blades, two at each end, that are reversible for extending the useful life of the blades in the tool.

Referring back to FIGS. 4*a* and 4*b*, it can be noted that different types of blades can be used at one end or the other end for different types of operation, for flooring, or shingling, or different types of cutting, or identical blades can be used, thus extending the time that the tool can be used between blade changes.

In construction, the housing 12 can be molded of a durable plastic or could be made of metal, and the blade covers also can be made of a molded, rigid plastic or made of metal. The restraining loop 24 is made of a tough material that cannot be torn and will not stretch appreciably, retaining the blade to prevent multiple-blade operation or extension. The blade restraining loop can also be modified or replaced with an equivalent structure that would allow a particular spacing between the actuating knobs, preventing one blade from being extended at the same time the other blade is extended, and may utilize springs or rigid spacers between the devices.

In summary, the invention can be constructed at low cost because of the simplistic molding required, and can greatly extend the time of use between blade changes for the multiple uses of the device without having to have the user carry a plurality of different kinds of blades. The device is inherently safe because the operation prevents extension of more than one blade at a time.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A dual blade utility knife comprising:

a pair of utility blades independently movable;

a narrow, hand-grippable housing having a first elongated blade receptacle body having two mirror image compartments, one at each end of said body, said body being mirror-imaged along its longitudinal center line forming a Z-shaped single housing body which is capable of receiving said utility blades, one at each end, said housing body including two additional body blade compartment covers identically shaped, each additional body blade compartment covers identically shaped, each cover mountable and removably attachable by a fastening means to said housing body for covering said blades, said housing body and said housing blade covers each forming an opening slot at each end of said housing body which allows a blade mounted within the blade cover to be moved and extended outwardly through said slot, said housing body including longitudinal top openings each having a recess, blade cover fasteners for removably connecting said blade covers to said housing body, first and second blade actuators for individually moving each blade independently, each blade actuator connected to a different blade, said blade actuators removably connected to said blades and each actuator having an actuating knob that connects to the actuator, and first and second blade restraining means;

said first and second blade restraining means including an elliptical band encircling said first and second blade actuators permitting independent movement of each of said first and second blades while preventing first and second blade extension simultaneously from said housing, said first blade being longitudinally movable relative to said housing body within said first blade compartment and said second blade being longitudinally movable within said second compartment, said first blade and said second blade each being accessible upon removal of within said blade compartment to a second position extending out of said housing for actuation and use of the blade, said second blade be movable to and from a first position inside said blade compartment to a position outside said compartment in a second position, said first and second actuators being restrained by said blade restraining means to prevent outward projection from said housing of both of said first and second blades at the same time.

2. A dual blade utility knife as in claim 1, wherein:

each blade may be reversible to double the amount of blade life within each compartment allowing the blade to be mounted in first or second direction with two separate blade surfaces.

* * * * *